US007017855B2

(12) United States Patent
Kojo et al.

(10) Patent No.: US 7,017,855 B2
(45) Date of Patent: Mar. 28, 2006

(54) METHOD IN REELING AND A REEL-UP

(75) Inventors: Teppo Kojo, Mäntsälä (FI); Janne Veräjänkorva, Espoo (FI)

(73) Assignee: Metso Paper, Inc., Helsinki (FI)

( * ) Notice: Subject to any disclaimer, the term of this patent is extended or adjusted under 35 U.S.C. 154(b) by 133 days.

(21) Appl. No.: 10/415,358

(22) PCT Filed: Oct. 29, 2001

(86) PCT No.: PCT/FI01/00941

§ 371 (c)(1),
(2), (4) Date: Aug. 8, 2003

(87) PCT Pub. No.: WO02/34655

PCT Pub. Date: May 2, 2002

(65) Prior Publication Data

US 2004/0041055 A1 Mar. 4, 2004

(30) Foreign Application Priority Data

Oct. 27, 2000 (FI) ..... 20002375

(51) Int. Cl.
*B65H 18/16* (2006.01)
*B65H 19/30* (2006.01)

(52) U.S. Cl. ..... 242/541.1; 242/541.7; 242/542.3; 242/160.1

(58) Field of Classification Search ..... 242/541.4, 242/541.5, 541.6, 541.7, 542.3, 541.1
See application file for complete search history.

(56) References Cited

U.S. PATENT DOCUMENTS 5,251,835 A 10/1993 Kyytsönen
5,370,327 A 12/1994 Adamski (Continued)

FOREIGN PATENT DOCUMENTS

WO WO 99/42395 8/1999

(Continued)

OTHER PUBLICATIONS

International Preliminary Examination Report issued in International Patent Application No. PCT/FI01/00941.

(Continued)

*Primary Examiner*—John M. Jillions
(74) *Attorney, Agent, or Firm*—Stiennon & Stiennon

(57) ABSTRACT

Successive machine reels are reeled from a paper web (W) so the machine reel (R) that is becoming full is reeled in contact with a movable pressing device (5) at a second reeling nip (N2) in a final stationary reeling station apart from a device (1) forming a first reeling nip (N1). A new, empty reel spool (2) is taken to a transfer device (6) and the change is conducted when the reel spool is located in the transfer device (6). The reel spool (2) with machine reel (R) is transferred after the change by the transfer device (6), while in nip contact with the pressing device (5) away from the first nip contact (N1) to the final reeling station, where the machine reel is reeled so that it becomes full, in nip contact (N2) with the pressing device (5), whereafter the transfer device returns to the change station.

13 Claims, 12 Drawing Sheets

U.S. PATENT DOCUMENTS

| | | | | |
|---|---|---|---|---|
| 5,560,566 | A | 10/1996 | Bagnato | |
| 5,577,685 | A | 11/1996 | Junk | |
| 5,673,870 | A | 10/1997 | Fielding et al. | |
| 5,690,298 | A | 11/1997 | Rūck | |
| 5,931,406 | A | 8/1999 | Siebert | |
| 5,967,449 | A | 10/1999 | Thomas et al. | |
| 5,988,557 | A * | 11/1999 | Moller et al. | 242/541.5 |
| 6,129,305 | A * | 10/2000 | Moller et al. | 242/541.7 |
| 6,260,788 | B1 * | 7/2001 | Hultcrantz et al. | 242/542.3 |

FOREIGN PATENT DOCUMENTS

| | | |
|---|---|---|
| WO | WO 00/26131 | 5/2000 |
| WO | WO 02/34655 | 10/2001 |

OTHER PUBLICATIONS

International Search Report Issued in International patent application No. PCT/FI01/00941.

* cited by examiner

METHOD IN REELING AND A REEL-UP

CROSS REFERENCES TO RELATED APPLICATIONS

This application is a U.S. national stage application of PCT Application No. PCT/FI01/00941, filed Oct. 29, 2001, and claims priority on Finnish Application No. 20002375 filed Oct. 27, 2000, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to methods in reeling a paper web and to reel-up apparatus.

In the terminal end of a paper machine or finishing apparatus for paper, a paper web of several meters in width which is produced and/or treated at preceding machine sections, is reeled around a reel spool to form a machine reel. In this reeling up process a reeling cylinder that is arranged rotatable is typically used for guiding the paper web onto the machine reel, wherein the nip contact between the reeling cylinder and the machine reel is utilized to affect the quality of the reel produced thereby. A conventional solution is the one in which the reeling cylinder remains in its place and the reel spool around which the reel is accumulated in nip contact is moved during reeling on the supporting structure, for example by supporting the ends of the reel spool on reeling rails. The ends of the reel spool are acted upon with a suitable loading mechanism to adjust the nip contact between the machine reel that is being formed and the reeling cylinder. Such reeling concepts and loading methods related thereto are disclosed for example in the Finnish patent 91383 and in the corresponding U.S. Pat. No. 5,251,835, as well as in the Finnish patent application 950274 and in the corresponding U.S. Pat. No. 5,690,298.

Another known solution is the one in which the reeling cylinder is arranged to move on a carriage, and the machine reel is rotated with a centre drive in a stationary reeling station, i.e. the centre of the reel spool remains at the same location. When the diameter of the machine reel is increased, the reeling cylinder is displaced in such a manner that the carriage supporting the same moves along a guide. Such an arrangement is known for example from the European application publication 792829 and in the corresponding U.S. Pat. No. 5,988,557.

The U.S. Pat. No. 5,370,327 discloses a solution in which the reeling cylinder moves in the vertical direction, thus enabling the maintaining of the angular position of the nip between the reeling cylinder and the machine reel constant when the reel moves on reeling rails. The low position of the reeling cylinder and the movement of the same in the vertical direction enable the transfer of the reel spools from a storage to a reeling station along a straight transfer path. The solution contains two pairs of reeling carriages, of which the pair that has delivered a full machine reel can return to fetch a new empty reel spool past the other pair guiding the reel to be reeled. A corresponding reel-up containing a stationary reeling cylinder in a low position and a reeling station moving by means of carriages, is known from the U.S. Pat. No. 5,673,870. Both solutions contain a drive motor moving along rails together with the movement of the respective pair of carriages on both sides of the reel-up, said drive motor being coupled to a reel spool located in the pair of carriages.

In addition to the stationary reeling cylinder that guides the web on the reel, according to the Finnish patent application 950274 and the corresponding U.S. Pat. No. 5,690,298, it is possible to use an auxiliary roll located at a lower position and moving in the vertical direction, said auxiliary roll forming a second nip with the machine reel formed in the moving reeling station. Before the change this auxiliary roll is in contact with the reel that is becoming full, which has been driven off the reeling cylinder. A corresponding arrangement in connection with a change is disclosed in the Finnish patent 91383/U.S. Pat. No. 5,251,835.

The aim is to obtain constantly larger machine reels to minimize reel changes. At present, machine reels are generally rotated with a centre drive, i.e. the end of the reel spool is connected to the drive motor with a suitable transmission mechanism. In primary reeling in which a new reel spool is brought in contact with the paper web travelling via the reeling cylinder, the reel spool is rotated with the center drive of the initial reeling device to accelerate the reel spool to the web speed and to form the bottom layers of the reel after the cutting and change of the web. The initial reeling device (which, according to the aforementioned U.S. Pat. Nos. 5,251,835 and 5,690,298, can be a pair of swinging arms pivotable in the vertical plane, or according to the U.S. Pat. Nos. 5,370,327 and 5,673,870 always one of the pair of carriages) is always accompanied by a drive motor of its own, and another drive motor moves along with a transfer device, such as reeling carriages, which are in contact with the ends of the reel spool during final reeling.

SUMMARY OF THE INVENTION

It is an aim of the invention to introduce a new reel-up concept with a simpler structure. By means of a combination of the transfer device moving the reel, two devices forming each a reeling nip, and a stationary final reeling station it is possible to implement the reel change, initial reeling and reeling into a full reel by means of a simple solution. With the transfer device it is possible to implement both initial reeling and the transfer of the reel away from the device forming the first reeling nip and the transfer to the final reeling station. By means of the stationary reeling station it is possible to implement, for example, the oscillation of the reel.

As for the other embodiments of the invention and the advantages of the same, reference is made to the appended dependent claims and to the description hereinbelow.

BRIEF DESCRIPTION OF THE DRAWINGS

In the following, the invention will be described in more detail with reference to the appended drawings.

DESCRIPTION OF THE PREFERRED EMBODIMENTS

Figure 1:
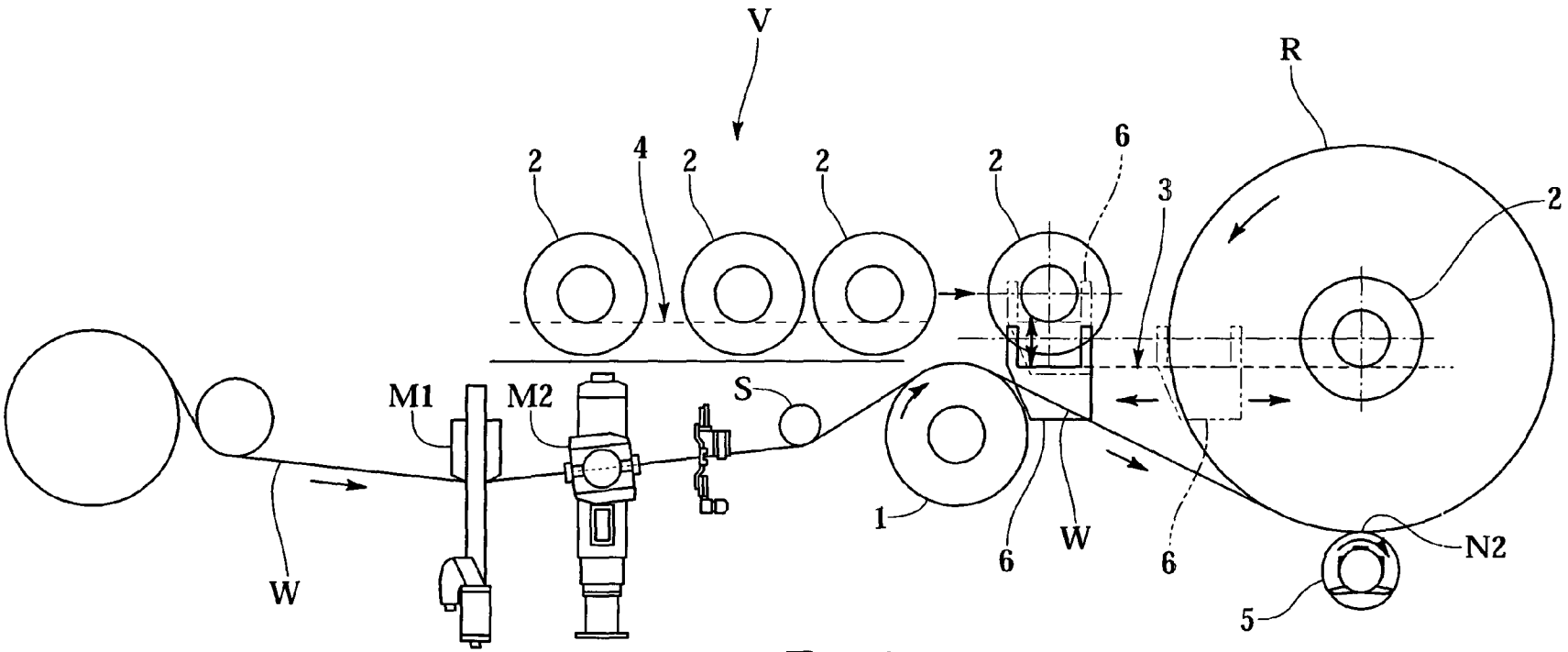
FIGS. 1 to 8 illustrate the different stages of the reeling up process in a side view.

FIGS. 1 to 8 show a continuously operating reel-up in which a paper web W which is normally several meters wide and is passed from the preceding section of a paper machine or finishing apparatus of paper, travels for example via a tension measurement device M1, a measurement beam M2 and a spreader roll S to a device forming a first reeling nip, a reeling cylinder 1, the cylinder being journalled rotatable in a stationary position in bearing supports and rotated with a drive of its own. On the reeling cylinder the web travels within a particular sector and is passed from the reeling cylinder 1 to a machine reel R which is formed around a reel spool 2 rotated with a centre drive of its own. It is possible for the reel spool 2 to move in the machine direction with respect to the reeling cylinder 1, and this is arranged in such a manner that the bearing housings at the ends of the reel spool that enable the rotation of the reel spool 2 are supported with suitable supporting structures, such as on reeling rails 3 extending in the machine direction. In the entry side of the reeling cylinder 1 there is also a storage V of empty reel spools 2 in which the rolls are supported at their bearing housings by rails 4. The rolls 2 of the storage V are located on a higher level (for example approximately 50 cm) than the reel spool 2 located on the reeling rails 3 in the reeling station, i.e. the rails 4 of the storage V are located on a higher level than the reeling rails 3.

The machine reel R can be transferred along the reeling rails 3 in the machine direction by means of a transfer device 6, which is moved by means of actuators attached to the frame of the reel-up. The transfer device 6 is arranged to move along guides extending in the machine direction, and it is composed of a carriage located at both ends of the reel spool and in contact with the bearing housing in the end of the reel spool by means of locking jaws or the like. The function of the transfer device 6 and the structure of the carriages belonging to the same are described in more detail hereinbelow.

FIG. 1 shows a situation in which the machine reel R is becoming full in the final reeling station in which it is off the contact with the reeling cylinder 1 in such a manner that the web W runs freely directly from the reeling cylinder to the reel R. The reeling nip N2 is formed in the final reeling station between the reel and a separate, movable pressing device 5 (in the figure a rotating pressure roll) that is loaded against the reel R with a predetermined force. The pressing device forms the second reeling nip N2 of the reel-up in which it is possible to use linear load as one reeling parameter. The pressing device 5 is located below the reel R after the point in which the web W enters the reel. In the situation of FIG. 1 the pressing device 5 forms the only reeling nip N2 when the reel R is detached from the reeling cylinder 1.

The reel change takes place at the production speed, i.e. the travel of the paper web passed at high speed to the full reel is changed to a new reel spool. As can be seen in FIG. 1, the new reel spool 2 can be brought from a storage V along a straight transfer path over the uppermost point of the reeling cylinder 1 to that side of the reeling cylinder 1 in which the machine reel R is formed in the final reeling station. The transfer of the reel spool 2 from the storage V can be implemented by means of supporting arms contained in the storage, which supporting arms support the reel spool at the ends and transfer the same in the horizontal direction to a point in which the transfer device 6 can take the reel spool on its support.

The final reeling station shown in FIG. 1, in which the machine reel R becomes full before the reel change, has a fixed position, i.e. the centre of the reel spool 2 does not move although the radius of the reel is increased. It is, however, possible to move the reel spool in this stationary reeling station in ways described hereinbelow. In this final reeling station the reel spool 2 is rotated by means of a centre drive, the drive motor of which can be fixed to a stationary position in the frame of the reel-up to rotate the reel spool 2 by means of suitable power transmission. In the situation of FIG. 1, the transfer device 6 moving the reel in the machine direction has been driven to a change station close to the reeling cylinder 1 and underneath a new reel spool 2 brought over the reeling cylinder 1.

Figure 2:
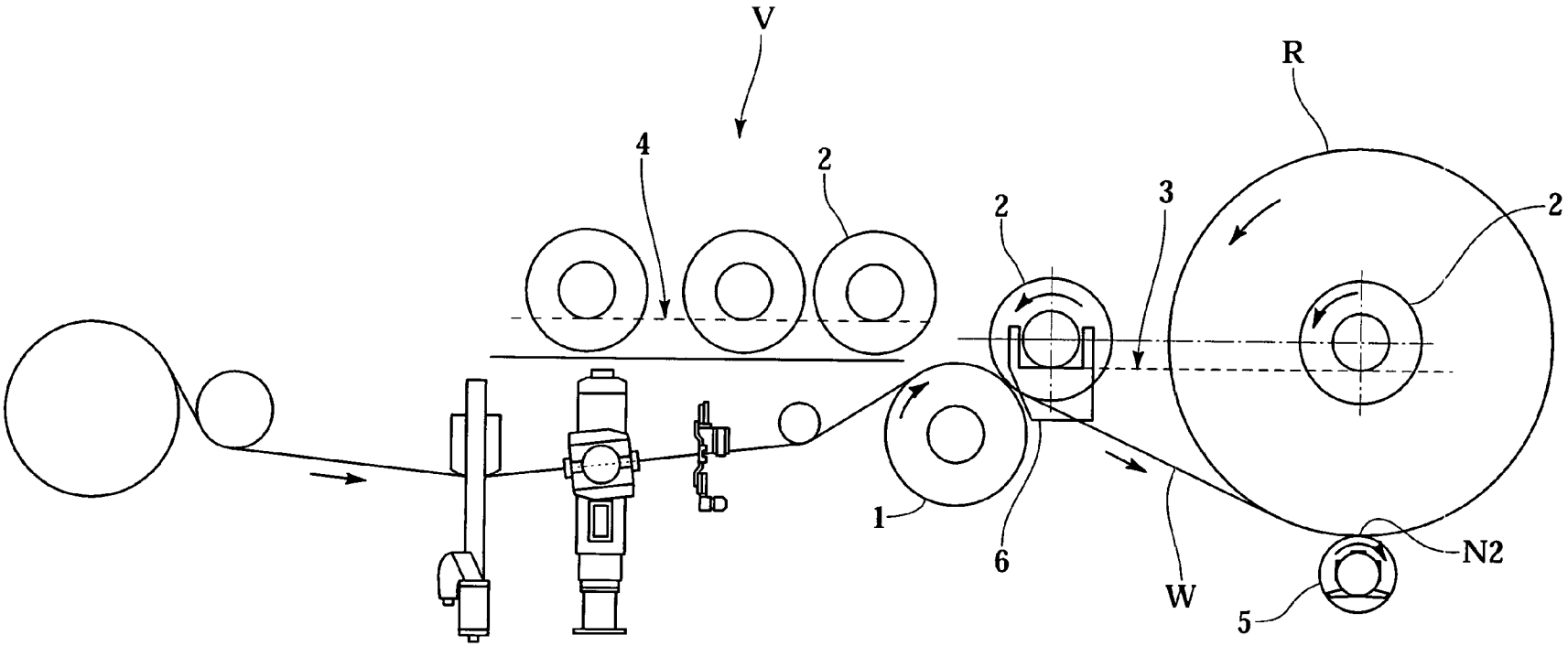

In FIG. 2 the new reel spool has been placed in the transfer device 6. The transfer device 6 may comprise a carriage connected to each end of the reel spool 2 and arranged to move in linear guides parallel to the reeling rails 3. In FIG. 2 the reel spool 2 located in the carriages is off the nip contact with the reeling cylinder 1, but the web W coming from the reeling cylinder can after a short free run travel a short distance along the periphery of the reel spool. The carriages can fetch the new reel spool in such a manner that they are lifted up on the level of the storage V, they take over to support the reel spool pushed forward from the storage, and then are lowered down. Before the reel spool 2 is transferred along the reeling rails 3 it is locked in place in the carriages. The structure of the carriages for accomplishing this is illustrated hereinbelow with reference to FIGS. 13 and 14.

Figure 3:
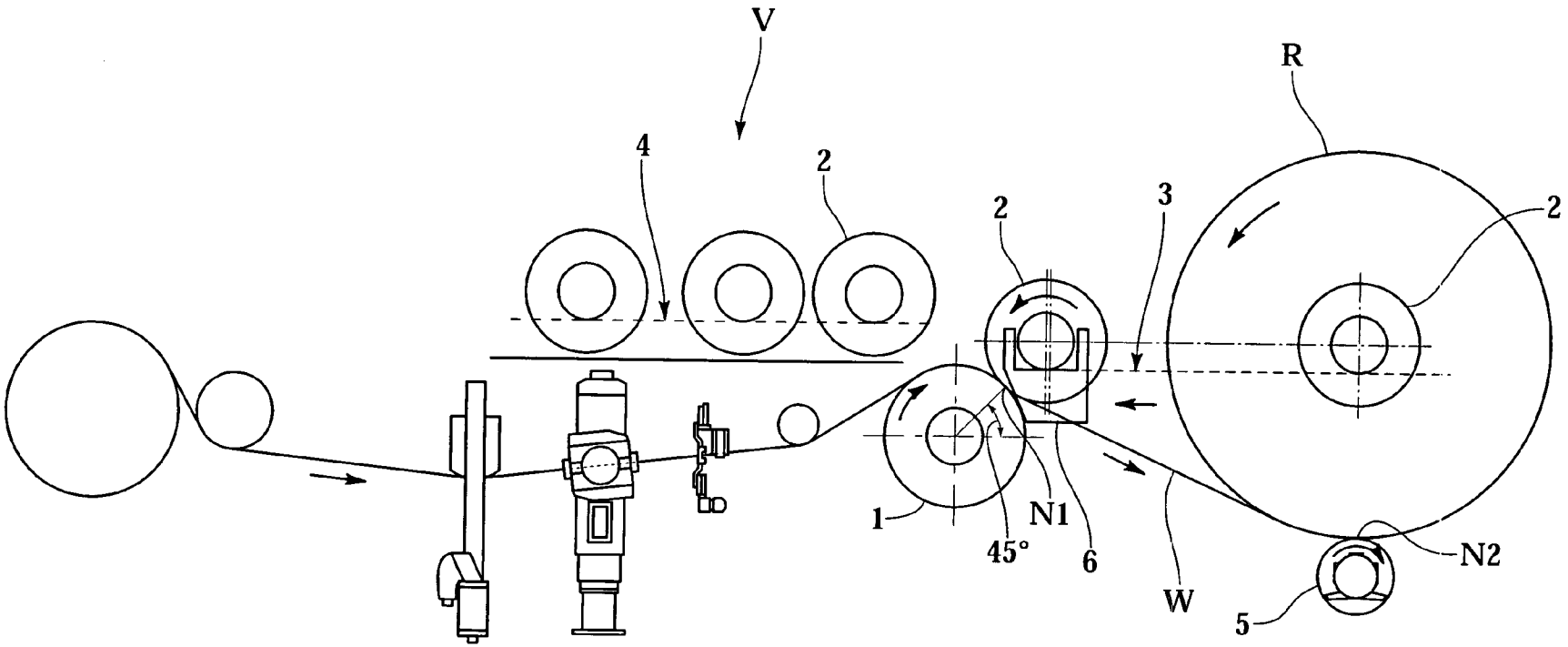

In FIG. 3 the transfer device 6 has been driven a short distance against the incoming direction of the web W, i.e. in a direction opposite to the actual transfer direction of the transfer device. The reel spool 2 enters in nip contact N1 with the reeling cylinder 1 in the change station. The rails 3 are at such a height above the centre of the reeling cylinder 1 that the point of contact is on the periphery of the reeling cylinder in the range of 40 to 50°, advantageously approximately 45° from the horizontal plane. The point of contact is thus also at the location of 40 to 50° on the periphery of the reel spool downwards from the horizontal plane passing through the centre of the reel spool. In said position the contact with the reeling cylinder is such that the radial and peripheral forces acting upon the reel are approximately equal to each other. Before the reel spool is driven against the paper web W travelling on the reeling cylinder 1 at production speed, it is coupled to a drive moving along with the transfer device 6 and it is accelerated to said speed. The rotation of the reel spool can be started already when it has been taken in the transfer device and is still located on the upper level.

Figure 4:
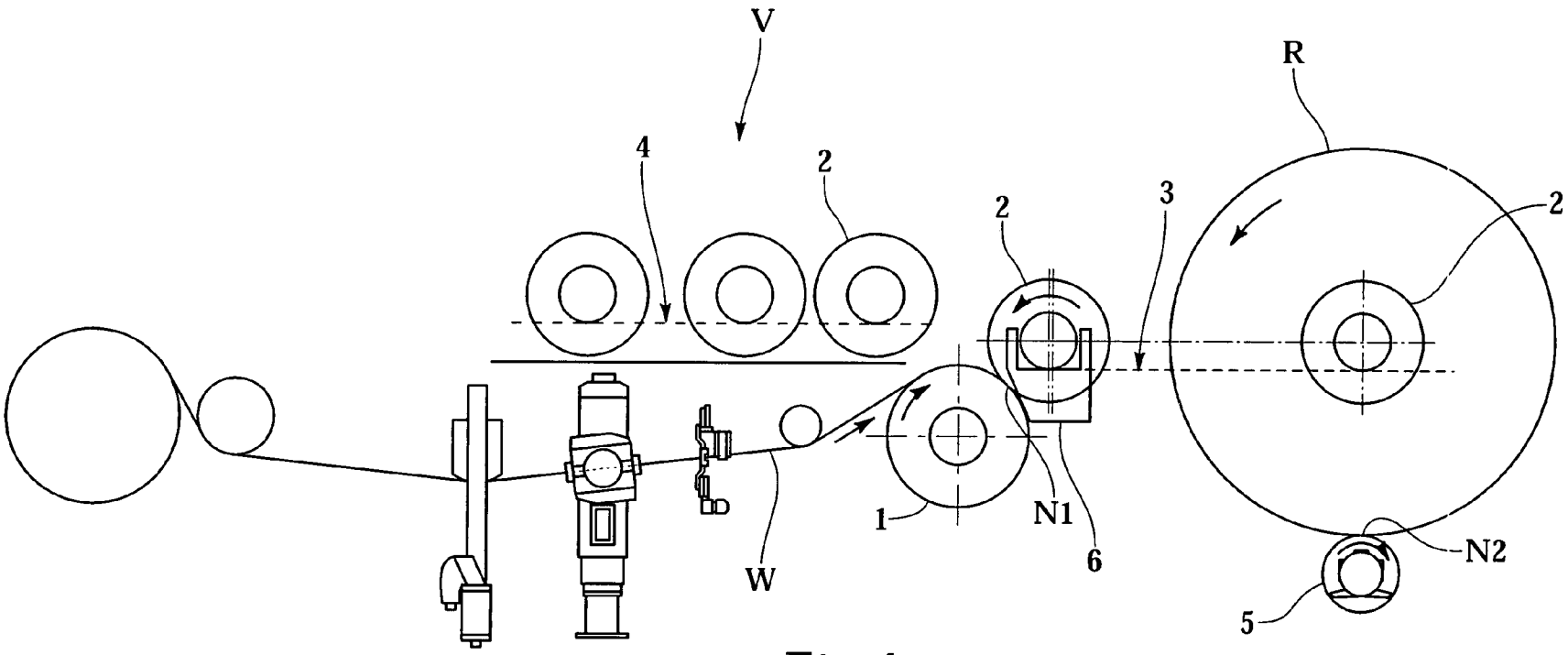
Figure 5:
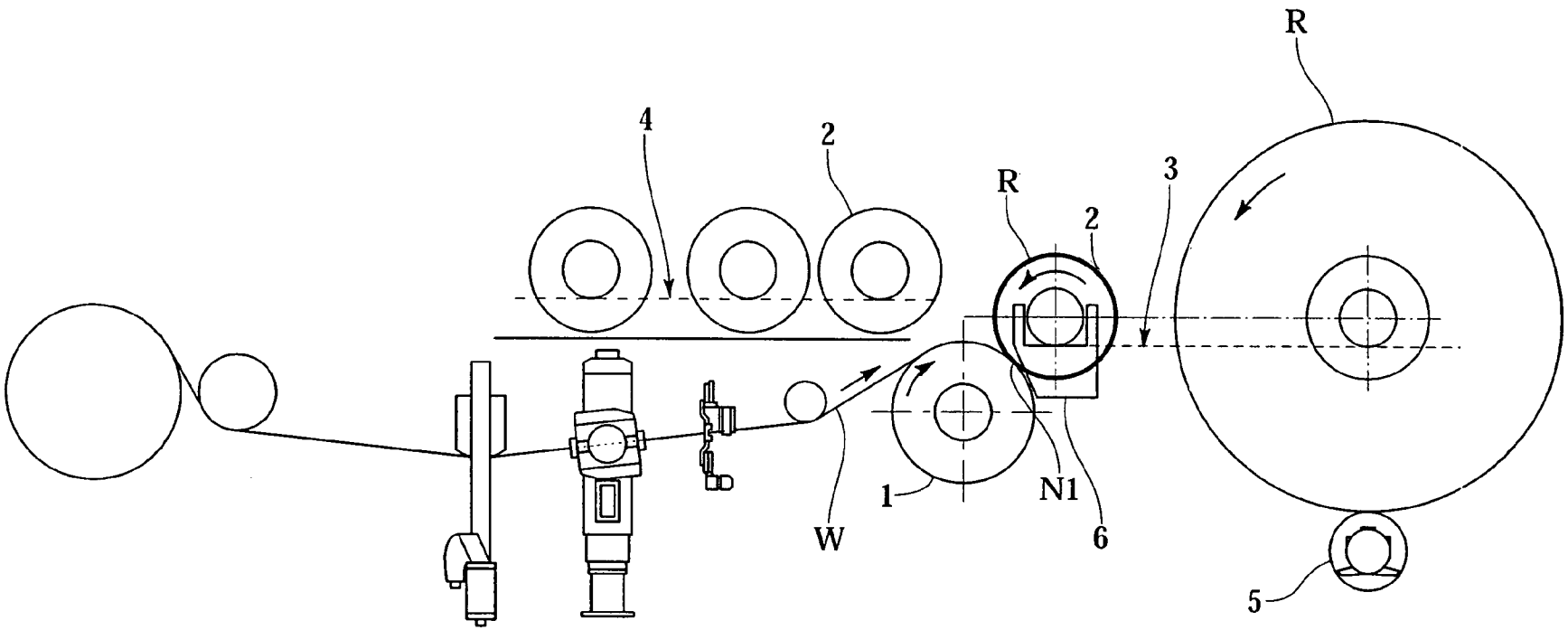

In FIG. 4 a reel change has taken place by means of some known change method, by means of which the web passed to the full machine reel R is cut and passed around the new reel spool 2 on which a new machine reel starts to form. The full machine reel R can now be decelerated and stopped when the pressing device 5 is still in contact with the peripheral surface of the reel. The initial reeling of the web W is thus implemented with one nip, i.e. the first reeling nip N1 between the reeling cylinder 1 and the machine reel R that has started to form (FIG. 5), in which reeling nip it is possible to use the linear load of the nip as a reeling parameter.

Figure 6:
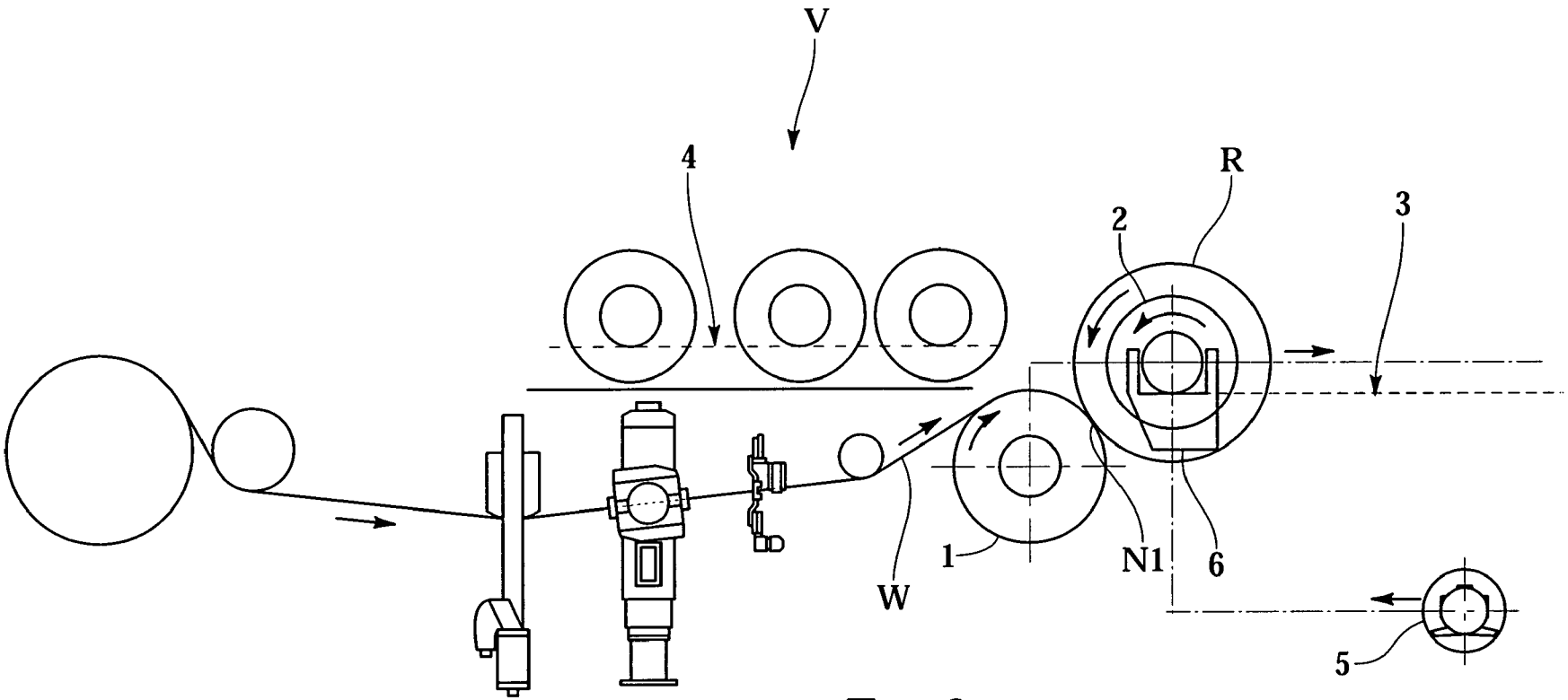

FIG. 6 shows a situation in which the clutch of the drive of the stationary final reeling station has been opened, and the full machine reel R has been removed from the final reeling station by rolling it forward for example on the rails 3. Along with the increase in the diameter of the new machine reel R the transfer device 6 has started to move in the direction of the rails 3. The linear load in the nip N1 can be adjusted with suitable force devices acting upon the ends of the reel spool, for example with the same actuators which are used for moving the transfer device 6.

Figure 7:
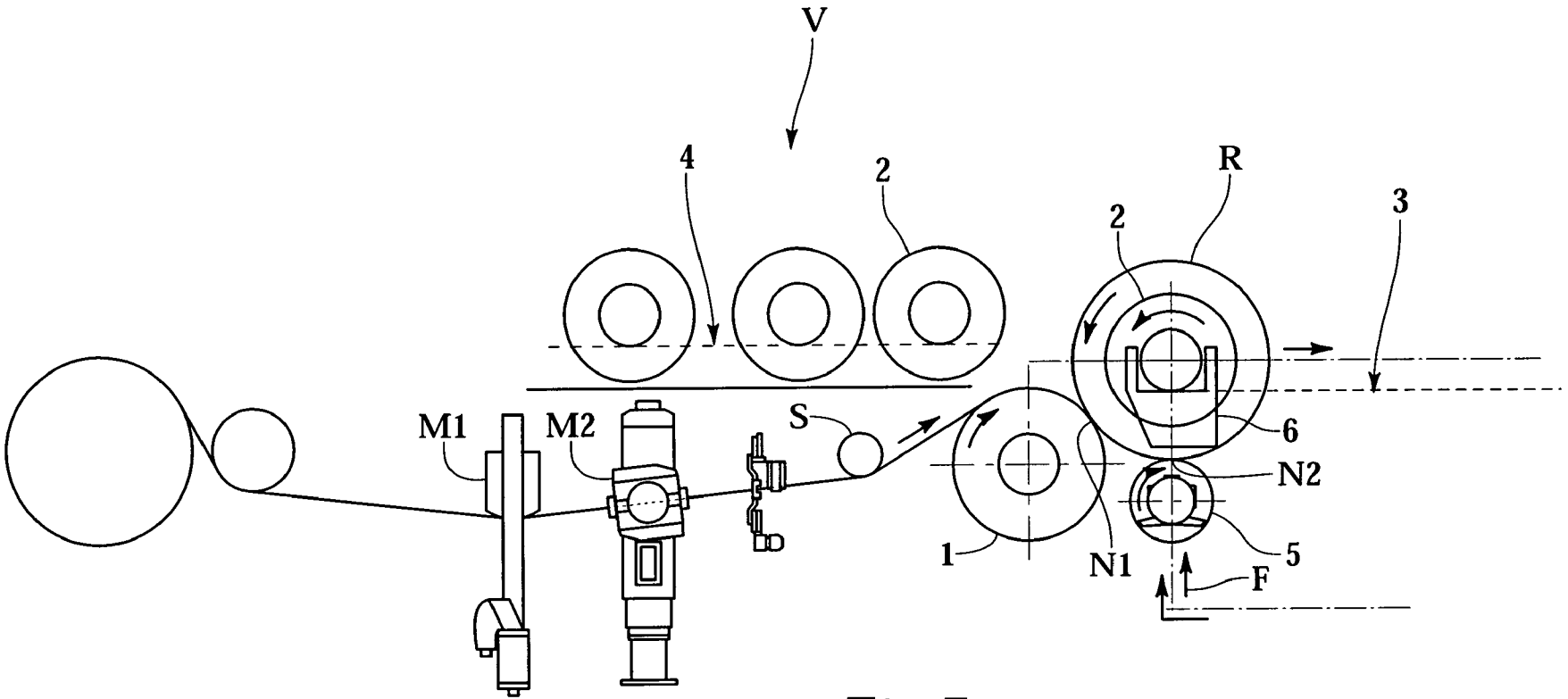

In FIG. 7 the pressing device 5 has been driven underneath a new machine reel R that is being formed and lifted up into nip contact with the underside of the reel. In the initial reeling station shown in FIG. 7 there are now two nips, a first nip N1 formed by the reeling cylinder 1 via which the web W is guided onto the reel R, and a second nip N2 located within a short distance from the first nip N1 in the direction of rotation of the reel, said second nip being formed for example by means of said pressing device 5. The nip change (the changing over from reeling through nip N1 to reeling through nip N2) is conducted in such a manner that discontinuities are not caused in the reel structure.

Figure 8:
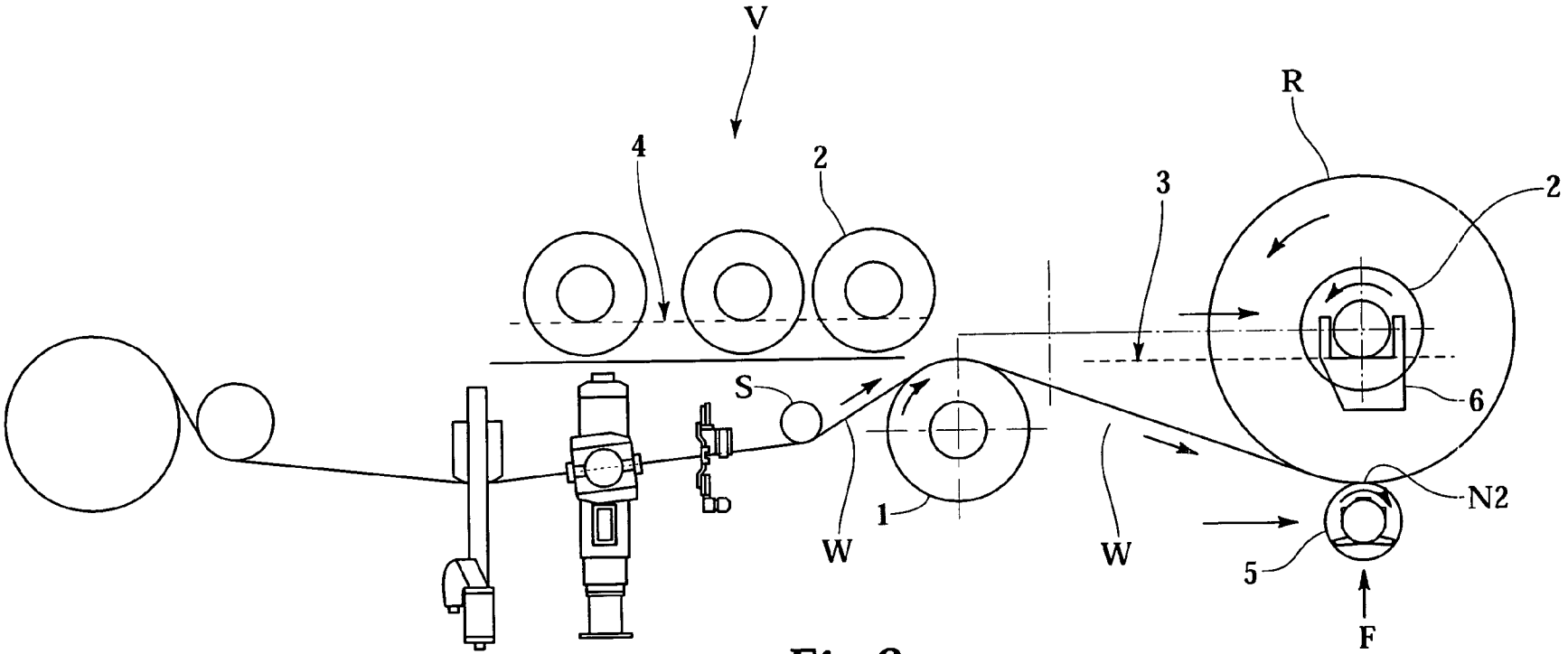

After the second nip N2 has been provided with the pressing device 5, it is possible to move over to the final reeling solely by means of this nip. FIG. 8 shows that the machine reel R has been transferred by means of the transfer device 6 from the primary reeling station of FIG. 7 to the final reeling station, off the reeling cylinder 1, and the reel spool 2 is locked in the final reeling station. During the transfer the pressing device 5 follows the roll, maintaining the nip contact N2 thereto with a desired loading force. The final reeling station has a fixed position, i.e. the location of the centre of the reel spool 2 does not change on the reeling rails 3 as a function of the radius of the reel. The linear load in the second reeling nip N2 is determined by the force (arrow F) with which the pressing device 5 is loaded against the topmost paper layers of the reel R. At the same time when the pressing device 5 is loaded against the machine reel R, it moves downwards along with the growth of the reel radius. The loading can be implemented with suitable force devices, for example hydraulic cylinders. When the machine reel R has been completed, the process is again in the situation of FIG. 1.

In the stationary final reeling station in which quantitatively the largest part of the paper web is reeled on the reel, it is possible to use a stationary drive motor. The transfer device 6 is accompanied by a moving drive motor. The change of the drive of the reel spool 2 and the reel R from the drive motor of the transfer device 6 to the drive motor of the final reeling station can be implemented in the final reeling station in such a manner that when the transfer device 6 has brought the reel R to the final reeling station, the reel spool 2 is locked therein by its ends (at the location of the bearing housings), the clutch of the drive of the final reeling station is coupled to the reel spool 2, torque is changed over from the drive of the transfer device 6 to the drive of the final reeling station, and the clutch of the drive of the transfer device 6 is released, whereafter the transfer device 6 can be detached from the reel spool 2 and transferred to the change station.

By means of the above-presented concept a simpler solution can be attained. In the frame structures of the reeling cylinder 1 in which said cylinder is journalled, a pivotable initial reeling device is not necessary, because the new reel spool 2 is transferred from the storage V directly to the transfer device 6, which is arranged to move the reel from the change station and initial reeling station to the final reeling station. The change reliability is, however, as good as in earlier solutions, and the change can be implemented in several known manners. The reeling cylinder 1 in a stationary position also makes it possible that the angle that the web W forms at the location of the spreader roll S is always constant.

The pressing device 5 can be attached to sledges, which are arranged in linear guides located underneath the reeling rails 3 and are advantageously parallel to rails 3. These sledges can be provided with force devices, which produce a vertical movement of the pressing device 5 and by means of which the load F can be achieved.

The stationary final reeling station also enables the oscillation of the reel R in such a manner that paper web W is reeled in the direction of its width to different locations of the reel, wherein it is possible to avoid the cumulation of small fluctuations occurring in the cross direction of the web. The oscillation is conducted in the final reeling station in which most of the paper web is reeled on the reel and in which the reeling faults caused by the uneven profile of the paper web are mainly produced.

Figure 9:
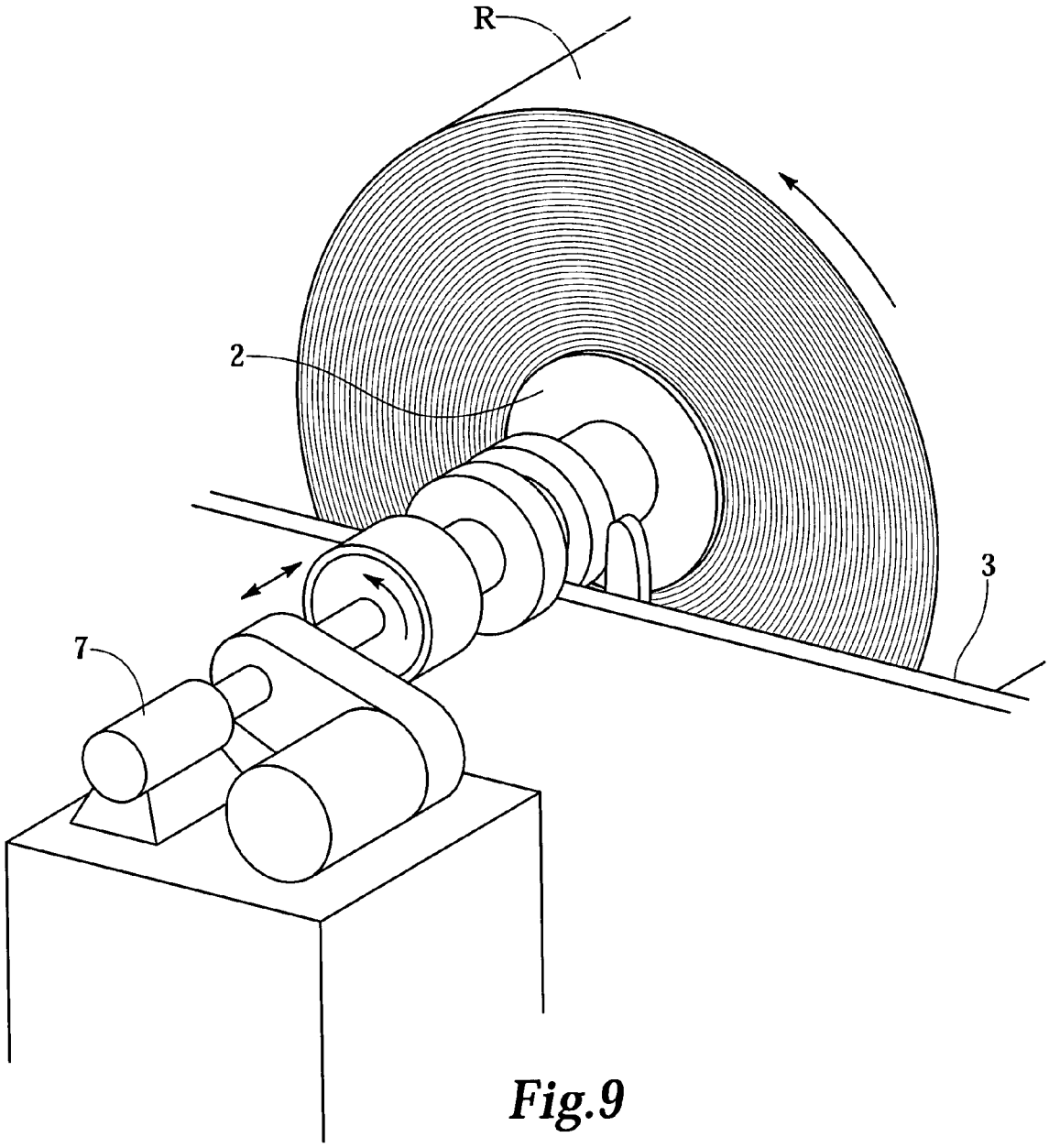
FIG. 9 illustrates a preferred embodiment of the invention in a perspective view.

FIG. 9 shows in a perspective view an alternative in which the reel spool resting by its ends on reeling rails 3 in the stationary final reeling station is oscillated for example in the manner disclosed in the international publications WO 99/42395 and WO 00/26131 of Metso Paper, Inc. by causing an axial reciprocating movement on the reel spool 2 by means of an actuator 7, said movement transferring the rotating machine reel R at the same time so that the paper web W coming from the reeling cylinder 1 is positioned at different locations in the width direction of the reel. The stationary reeling station may thus be equipped with sledges moving in the horizontal plane in a direction perpendicular to the rails, said sledges being attached to the rails and having the ends of the reel spool resting thereon. Alternatively, the bearing housing of the reel spool may be equipped with an outer sleeve which is stationary in the axial direction and allowing the inner part as well as the rotation shaft of the reel spool rotatable with respect to the inner part to move back and forth in the axial direction with respect to said outer sleeve, as is disclosed in the aforementioned international publications. In both cases the clutch of the centre drive is arranged in such a manner that the transmission of both reciprocating axial movement and rotating movement to the reel spool is possible. The reeling cylinder 1 and the pressure roll 5, which in this case has been transferred from the lowermost point of the machine reel R against the incoming direction of the web W for example to the point in which it guides the web on the reel in such a manner that the entry direction of the web deviates from the tangential direction, prevent the transfer of the web W sideways before the reel R.

The oscillating actuator 7 can be for example a hydraulic cylinder, and it can be coupled to the end of the reel spool on the same side where the drive motor of the fixed final reeling station is coupled, or on the opposite side. An actuator can also be located on each side.

The oscillation may be started in the final reeling station when a fixed amount of web has been accumulated on the reel, i.e. uneven cross profile properties of the web resulting from streaks of the web or the like start to appear on the surface of the reel on such a scale that they may cause troubles. It is, however, possible to start the oscillation immediately in the final reeling station, even before the final reeling station when the reel is in contact with the reeling cylinder 1 via the nip N1, if for example the transfer device 6 is provided with oscillation or a corresponding actuator/actuators. In this case the carriages of the transfer device 6 may be provided with an arrangement which allows the movement of the reel spool back and forth in the axial direction with respect to the carriages, for example by means of a solution disclosed in the international publications WO 99/42395 and WO 00/26131 of Metso Paper, Inc., in which the locking jaws holding the bearing housings at the ends of the reel spool contain sliding pieces that allow said reciprocating movement.

Figure 10:
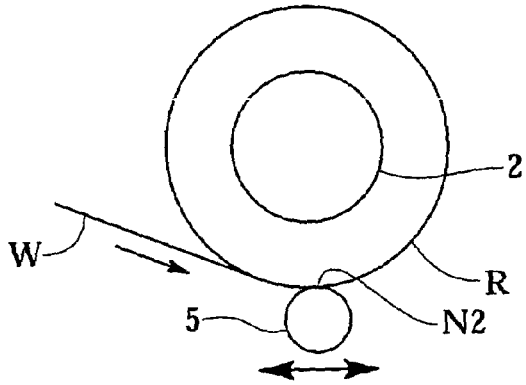
FIGS. 10 and 11 show a third preferred embodiment of the invention in a side-view.
Figure 11:
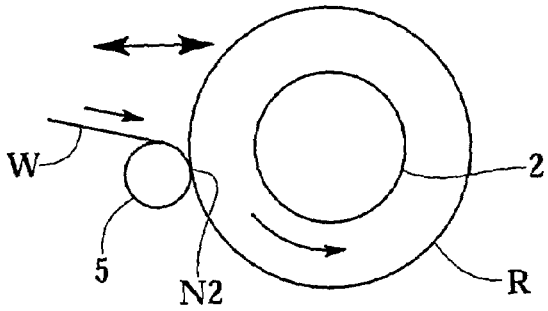
Figure 12:
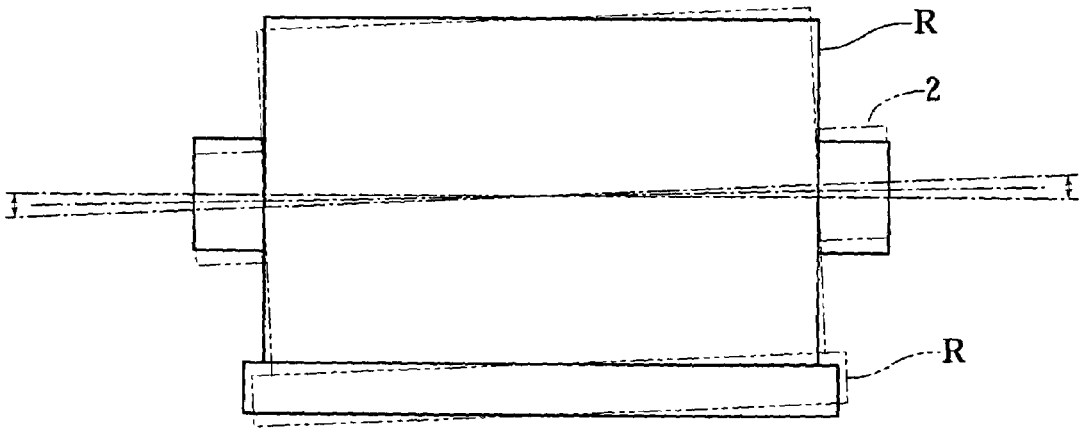
FIG. 12 shows the arrangement of FIG. 11 in a top view.

FIGS. 10 to 12 show another principle of performing oscillation in a stationary final reeling station. Here, the oscillation takes place by causing a rocking movement to the reel spool 2 and the reel accumulated around the same. The stationary final reeling station may contain sledges in which the ends of the reel spool 2 are locked and which are moved back and forth in guides. At the same time when the position of the sledges is changed, the position of the pressing device 5 is also changed in such a manner that it follows the rocking movement, i.e. it will be parallel to the centre of the reel spool 2. This can be implemented for example by transferring the sledges holding the ends of the pressing device back and forth in a synchronized manner with the movement of the reel spool. FIG. 10 shows a pressing device 5, which in this case is also a rotating pressure roll which can be loaded against the reel with a desired force, located underneath the reel approximately at the lowest point of the reel, forming a nip N2 with the same. In FIG. 11 the pressure roll is located in front of the reel in such a manner that it guides the paper web W coming from the reeling cylinder to the periphery of the reel, i.e. the web is passed towards the periphery of the reel in an angle larger than the tangential angle and travels over a certain sector on the press roll to the reel. FIG. 12 shows the situation of FIG. 11 schematically seen from above.

In the principle shown in FIGS. 10 to 12, the oscillation occurs symmetrically with respect to the centre of the reel spool 2, wherein both ends of the roll travel back and forth on both sides of the central position. Alternatively, oscillation can be implemented only for the other edge, i.e. one end of the reel spool 2 is transferred back and forth while the other end remains in its place.

In both ways it is possible to attain the same effect as by means of the oscillation principle shown in FIG. 9: the web is guided to different locations of the reel in the width direction of the reel, and thus it is possible to avoid the cumulation of the unevenness in the profile, for example the streaks, in a manner that disturbs reeling and impairs the quality of the reel.

Furthermore, it is obvious that the oscillation can occur at a predetermined suitable frequency and amplitude, for example according to the values presented in the aforementioned international publications. The amplitude of the oscillation when expressed as the distance between the extreme positions of the web on the reel is typically 100 mm at the most, advantageously between 2 and 50 mm. The maximum oscillation frequency is advantageously such that during one cycle at least 100 m, advantageously at least 200 m of web is reeled on the reel. For example at running speeds of 25 m/s, the distance of 100 m represents the frequency of 0.25 Hz, i.e. the movements do not have to be fast.

Although the reel spool 2 moves in the final reeling station as a result of the oscillation, the reeling station is stationary as the central position of the reel spool always remains the same when oscillation of fixed amplitude is performed.

Figure 13:
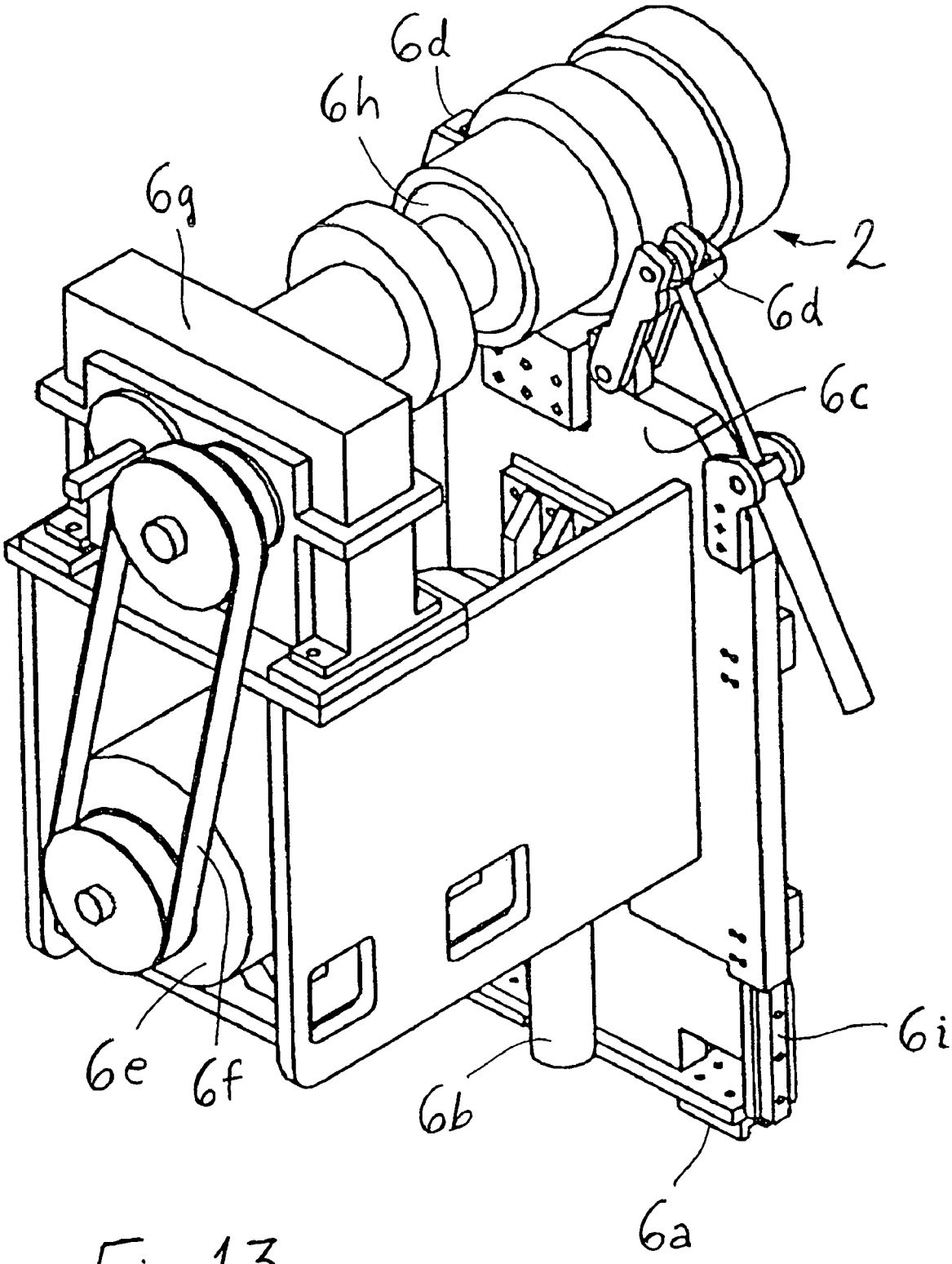
FIGS. 13 and 14 show a carriage used in the transfer device of the reel-up.
Figure 14:
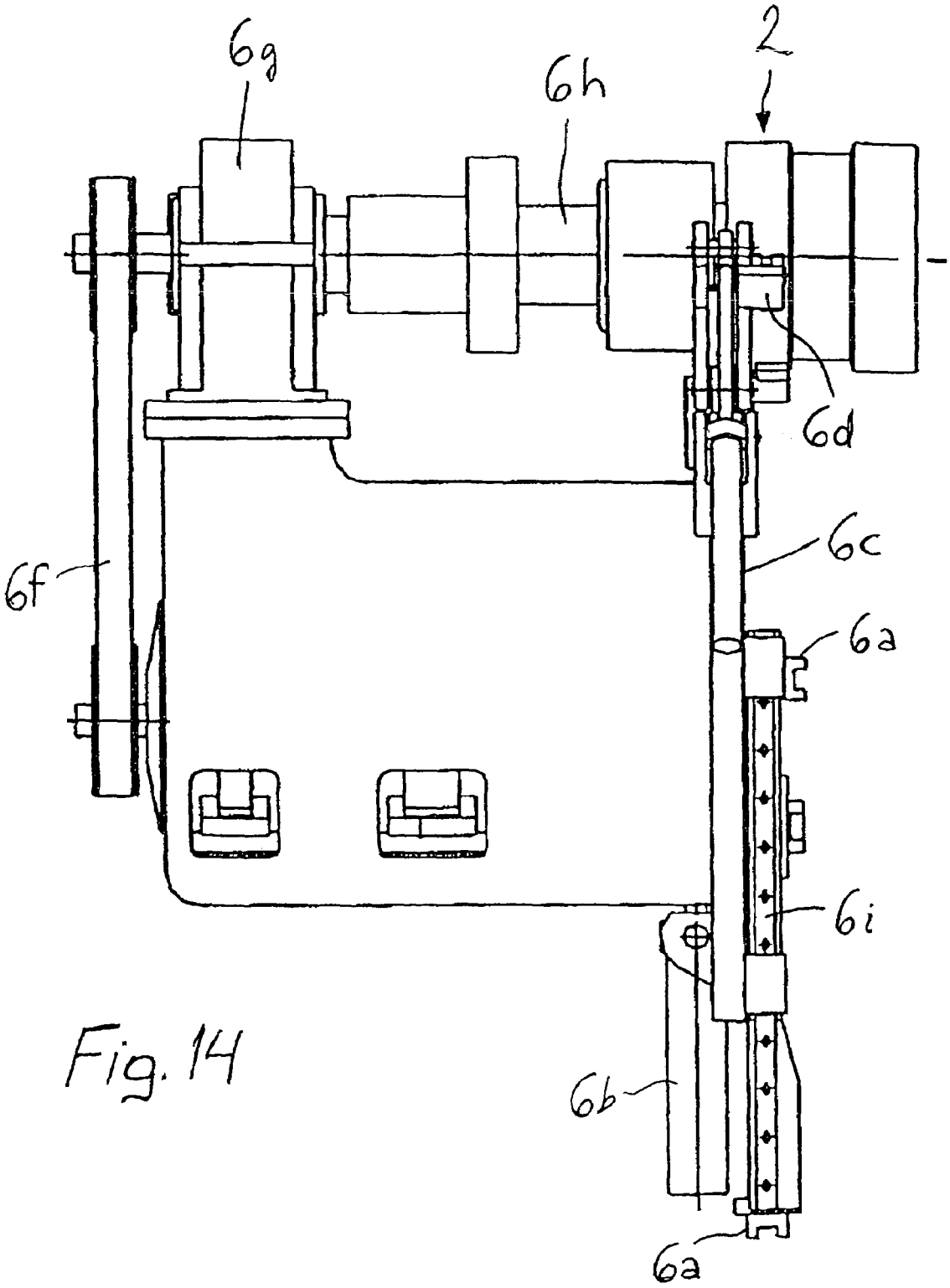

FIGS. 13 and 14 show a perspective view and front view of one of the carriages of the transfer device 6. The transfer device operates in such a manner that the carriages are arranged to move in guides (not shown) parallel to the reeling rails to move the reel spool and the reel in the machine direction in the manner disclosed hereinabove. In the carriages the horizontal linear guides that fit in the guides located in the frame of the reel-up are marked with the reference numeral 6*a*. The part of the carriage which is intended to hold the end of the reel spool is capable of moving up and down in the vertical direction with respect to the other part, and an actuator 6*b*, for example a hydraulic cylinder, is arranged to act between these parts. According to FIGS. 13 and 14 the part 6*c* which is in contact with the bearing housing of the reel spool and which contains the locking jaws 6*d* of the reel spool, and a drive motor 6*e*, its power transmission means 6*f* (transmission belt) and a gear 6*g*, all mounted on the part 6*c*, as well as a clutch 6*h* rotated by them and to be coupled to the rotation shaft of the reel spool, are arranged movable in the vertical direction. The part remaining in its place in the same height position comprises the horizontal linear guides 6*a* and vertical linear guides 6*i*, which guide the movement of the part 6*c* in the vertical direction. As a result of the vertical movement, it will be possible in the situation of FIGS. 1 and 2 to utilize the carriages to fetch a new empty reel spool from an upper position, said reel spool having been pushed above the carriages from the storage V by means of actuators of the storage V, and at the same time it is already possible to start rotating the reel spool in this upper position to accelerate it into the web speed. FIGS. 13 and 14 show a carriage on the tending side of the paper machine or finishing apparatus for paper if the drive of the stationary reeling station is on the drive side. The other carriage of the transfer device 6 on the drive side follows the same principle, but it does not contain a drive motor with associated power transmission devices.

The invention claimed is:

1. A method in reeling up machine reels successively from a paper web comprising the steps of:

removing an empty reel spool from a set of storage rails with a transfer device which provides vertical movement, to which a center wind assist is mounted for motion with the transfer device, and the transfer device is mounted for horizontal motion on a second set of rails spaced below the storage rails;

causing the empty reel spool to rotate about a spool axis by means of the center wind assist mounted to the transfer device;

transporting the empty reel spool downwardly on the transfer device to engage a fixed reeling cylinder so that the empty reel spool is positioned between the reeling cylinder and a machine reel which is becoming full;

transferring the paper web as it is moving over the reeling cylinder to the machine reel on to the empty reel spool so as to begin to form a new machine reel which engages the reeling cylinder at a first reeling nip;

engaging the new machine reel with a device forming a second reeling nip;

moving along the second set of rails the new machine reel mounted on the transfer device, in the downstream machine direction to a stationary final reeling station, the device forming a second reeling nip moving in a synchronized manner with the new machine reel;

engaging a second fixed center wind assist to the reel spool about which the new machine reel is forming; and disengaging the transfer device from the reel spool about which the new machine reel is forming and moving the transfer device to be positioned to remove a second empty reel spool from the set of storage rails.

2. The method of claim 1 wherein the empty reel spool is brought from the set of storage rails along a substantially straight transfer path over the topmost point of the fixed reeling cylinder forming the first reeling nip to a location from which it is transferred to the transfer device.

3. The method of claim 1 wherein the reel spool about which the new machine reel is forming is oscillated in the final reeling station in such a manner that the paper web coming to the machine reel is positioned in different locations of the reel in the cross direction of the web.

4. The method of claim 3 wherein the oscillation is conducted by causing a reciprocating axial movement to the reel spool.

5. The method of claim 3 wherein the oscillation is conducted by causing a reciprocating rocking movement to the reel spool.

6. The method of claim 1 wherein most of the paper web is reeled to the machine reel in the final reeling station.

7. The method of claim 1 wherein the first reeling nip is on the periphery of the reel spool in an angular position of 40° below a horizontal plane.

8. A reel-up which is arranged to form successive machine reels from a paper web comprising:

storage rails on which a plurality of empty reel spools are stored;

a fixed reeling cylinder positioned below the storage rails;

reeling rails positioned below the storage rails;

a transfer device mounted to the reeling rails for motion along the reeling rails, the transfer device having a center wind assist mounted for motion with the transfer device wherein the transfer device has a portion which engages a reel spool on which a machine reel is formed, and wherein the portion which engages a reel spool, and the center wind assist are mounted for vertical motion with respect to the reeling rails;

wherein the transfer device is movable to take an empty reel spool having a periphery from the storage rails and position the empty reel spool periphery into engagement with the fixed reeling cylinder to form a first reeling nip and to receive a paper web and thus form the machine reel;

a pressing device mounted below the reeling cylinder, and mounted for vertical motion and horizontal motion, and to move in a synchronized manner with the transfer device, and wherein the pressing device is moveable to form a second reeling nip with the machine reel, wherein the transfer device is movable to position said machine reel spaced from the fixed reeling cylinder along the reeling rails; and a fixed center wind assist positioned to engage the reel spool about which the machine reel is forming when the machine reel is positioned spaced from the fixed reeling cylinder along the reeling rails, and wherein the transfer device is movable while the machine reel is engaged with the fixed center wind assist to take a new empty reel spool from the storage rails.

9. The reel-up of claim 8 wherein the pressing device moveable to form the second reeling nip is a pressure roll arranged rotatably.

10. The reel-up of claim 8 wherein the first reeling nip is on the periphery of the reel spool in an angular position of 40° to 50° below a horizontal plane.

11. A reel-up which is arranged to reel successive machine reels from a paper web (W), comprising a device (1) forming a first reeling nip (N1) in an initial reeling station, and a device (5) forming a second reeling nip (N2) in a final reeling station to reel the machine reel (R) that is becoming full apart from the device (1) forming the first reeling nip (N1), and means for bringing a new, empty reel spool (2) to the change station into such a connection with the paper web (W) that enables a change, said paper web travelling via the device (1) forming the first reeling nip (N1) towards the machine reel (R) that is becoming full, the reel-up further comprising a movable transfer device (6) for moving the reel spool (2) away from the device (1) forming the first reeling nip (N1), characterized in that said movable transfer device (6) is arranged to move back and forth between the change station and the final reeling station, and the device (5) forming the second reeling nip (N2) is arranged to move back and forth between the final reeling station and the initial reeling station, said movable transfer device (6) being arranged to hold the new reel spool (2) in the change station during the change and to hold the machine reel formed around the new reel spool (2) in the initial reeling station in nip contact with the device (1) forming the first reeling nip (N1), and that the device (5) forming the second reeling nip (N2) is arranged to move from the final reeling station to the initial reeling station to a nip contact with the machine reel formed around the new reel spool (2), and said movable transfer device (6) is arranged to move the reel spool (2) and the machine reel (R) formed after the change around the reel spool away from the device (1) forming the first reeling nip (N 1) to the stationary final reeling station at the same time when the device (5) forming the second reeling nip (N2) is transferred along with the movement of said movable transfer device back to the final reeling station in nip contact with the machine reel, and the transfer device (6) is movable back to the change station while the machine reel remains in the final reeling station and the device (5) forming the second reeling nip (N2) remains in the final reeling station in nip contact with the machine reel.

12. The reel-up according to claim 11 characterized in that the the device (5) forming the second reeling nip (N2) is a pressure roll arranged rotatable.

13. The reel-up according to claim 11 characterized in that the transfer device (6) comprises a carriage on each side of the reel-up, said carriage being arranged to move in the transfer direction guided by a guide or the like, and in each carriage a part (6*c*) which is arranged to move in the vertical direction with respect to the part of the carriage that moves in the transfer direction, for taking a new, empty reel spool (2) from an upper level and lowering it to a lower level.

* * * * *